US007633372B2

(12) United States Patent
Araki et al.

(10) Patent No.: US 7,633,372 B2
(45) Date of Patent: Dec. 15, 2009

(54) CHIP TYPE VARIABLE ELECTRONIC PART AND CHIP TYPE VARIABLE RESISTOR

(75) Inventors: Akiko Araki, Ibaraki (JP); Tadatoshi Miwa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 61 days.

(21) Appl. No.: 11/597,022

(22) PCT Filed: Apr. 13, 2005

(86) PCT No.: PCT/JP2005/007152

§ 371 (c)(1),
(2), (4) Date: Nov. 17, 2006

(87) PCT Pub. No.: WO2005/114680

PCT Pub. Date: Dec. 1, 2005

(65) Prior Publication Data

US 2007/0229211 A1 Oct. 4, 2007

(30) Foreign Application Priority Data

May 20, 2004 (JP) ..... 2004-150869

(51) Int. Cl.
*H01C 10/30* (2006.01)

(52) U.S. Cl. ..... 338/160; 338/162

(58) Field of Classification Search ..... 338/160
See application file for complete search history.

(56) References Cited

U.S. PATENT DOCUMENTS 4,785,277 A * 11/1988 Yashiro ..... 338/162

(Continued)

FOREIGN PATENT DOCUMENTS

JP 63-124705 8/1988

(Continued)

OTHER PUBLICATIONS

Japanese Office Action from the corresponding JP 2004-150869, mailed May 16, 2007.

*Primary Examiner*—Elvin G Enad
*Assistant Examiner*—Joselito Baisa
(74) *Attorney, Agent, or Firm*—Hamre, Schumann, Mueller & Larson, P.C.

(57) ABSTRACT

A chip type variable electronic part includes an insulating substrate with a through hole, an adjustment rotor formed of a metal plate in a bowl shape to receive a screwdriver and disposed on the upper surface of the insulating substrate, an internal terminal electrode plate made of a metal plate disposed in close contact with a lower surface of the insulating substrate, and a shaft portion integrally formed with the internal terminal electrode plate to be fitted in the through hole. A bottom plate of the adjustment rotor is rotatably fitted to the upper end portion of the shaft portion, and the upper end portion of the shaft portion is crimped to outwardly extend over the upper surface of the bottom plate. A portion of the bottom plate of the adjustment rotor, fitted over the shaft portion, is located at a lower level than the uppermost edge of an inner portion of the through hole on the upper surface of the insulating substrate. Thus, the overall height of the chip type variable electronic-part is reduced with an increased insertion depth of a screwdriver into the rotor.

12 Claims, 4 Drawing Sheets

U.S. PATENT DOCUMENTS 6,628,193 B2 * 9/2003 Doi et al. ..... 338/162

FOREIGN PATENT DOCUMENTS

JP 2-101709 4/1990
JP 7-147206 6/1995
JP 11-354307 12/1999
JP 2001-76910 3/2001
JP 2002-50505 5/2002

* cited by examiner

CHIP TYPE VARIABLE ELECTRONIC PART AND CHIP TYPE VARIABLE RESISTOR

TECHNICAL FIELD

The present invention relates to a chip type variable electronic part and a variable resistor constituted of an insulating substrate in the form of a chip, with a rotor for controlling e.g. the resistance or capacitance that is rotatably mounted on the substrate.

BACKGROUND ART

The chip type variable resistor which represents the variable electronic parts is, as conventionally well known, disclosed for example in the patent document 1.

The chip type variable resistor includes an insulating substrate formed in a chip type with a through hole provided at a central portion thereof, a resistance film provided on an upper surface thereof in an arcuate shape concentric with the through hole, an external terminal electrode corresponding to the respective end portions of the arcuate resistance film provided on the insulating substrate, and an internal terminal electrode plate made of a metal plate adhered to a lower-surface of the insulating substrate and including an integrally formed hollow shaft portion that fits in the through hole. On the upper surface side of the insulating substrate, an adjustment rotor formed of a metal plate in a bowl shape and including a sliding piece that makes contact with the resistance film, is fitted over an upper end portion of the shaft portion such that a bottom portion of the rotor makes close contact with the upper surface of the insulating substrate, and the rotor is rotatably mounted on the insulating substrate by crimping the upper end portion of the shaft portion to outwardly extend, thereby allowing insertion of a screwdriver into inside the rotor for rotating the rotor.

In the chip type variable resistor thus configured, the rotor that controls the resistance is designed to receive insertion of a screwdriver that rotates the rotor into an inner portion thereof. For the screwdriver to be sufficiently engaged with the rotor, a certain insertion depth for the screwdriver has to be secured inside the rotor.

In the conventional chip type variable resistor, however, the rotor is fitted over the upper end portion of the shaft portion such that the bottom portion of the rotor makes close contact with the upper surface of the insulating substrate, and the upper end portion of the shaft portion is crimped to outwardly extend over the bottom plate as described above, and therefore increasing the insertion depth of the screwdriver into an inner portion of the rotor leads to an increase in height of the rotor from the upper surface of the insulating substrate, and hence to an increase in overall height of the chip type variable resistor, thus incurring an increase in size of the chip type variable resistor.

However, reducing the thickness of the insulating substrate or forming a recess on the upper surface of the insulating substrate at a position where the bottom plate of the rotor is mounted in order to reduce the overall height leads to degradation in strength of the insulating substrate, thereby resulting in frequent cracking thereof, in the manufacturing process as well as in the implementation on a PCB.

Patent document 1: JP-A-H11-354307

DISCLOSURE OF THE INVENTION

Problems to be Solved by the Invention

A technical object of the present invention is to provide a chip type variable electronic part and a variable resistor in which the foregoing problems are minimized.

Means for Solving the Problems

To achieve the technical object, a first aspect of the present invention provides a chip type variable electronic part including an insulating substrate with a through hole, an adjustment rotor formed of a metal plate in a bowl shape to receive a screwdriver and disposed on an upper surface of the insulating substrate, an internal terminal electrode plate made of a metal plate disposed in close contact with a lower surface of the insulating substrate, and a shaft portion integrally formed with the internal terminal electrode plate to be fitted in the through hole, in which a bottom plate of the adjustment rotor is rotatably fitted over an upper end portion of the shaft portion, and the upper end portion of the shaft portion is crimped to outwardly extend over an upper surface of the bottom plate, wherein a portion of the bottom plate of the adjustment rotor that is fitted over the shaft portion is located at a lower level than an uppermost edge of an inner portion of the through hole on the upper surface of the insulating substrate.

A second aspect of the present invention provides the chip type variable electronic part according to the first aspect, wherein the portion of the bottom plate of the adjustment rotor that is fitted over the shaft portion and the upper end portion of the shaft portion crimped to extend outward are both located at a lower level than the uppermost edge of the inner portion of the through hole on the upper surface of the insulating substrate.

A third aspect of the present invention provides the chip type variable electronic part according to the first aspect or the second aspect, wherein the portion of the bottom plate of the adjustment rotor that is fitted over the shaft portion is disposed in contact with the internal terminal electrode plate.

A fourth aspect of the present invention provides the chip type variable electronic part according to any of the first to the third aspects, wherein a plate thickness of a portion of the internal terminal electrode plate around the shaft portion is partially reduced, and a film that covers an inner portion of the hollow shaft portion is adhered to a lower surface of the portion with the reduced thickness.

A fifth aspect of the present invention provides the chip type variable electronic part according to any of the first to the fourth aspects, wherein the portion of the internal terminal electrode plate around the shaft portion is located in the through hole, and includes an fold-back piece integrally formed in the portion around the shaft portion to cover an inner portion thereof.

A sixth aspect of the present invention provides the chip type variable electronic part according to the third aspect, further comprising a friction plate interposed between the bottom plate of the rotor and the internal terminal electrode plate.

A seventh aspect of the present invention provides the chip type variable electronic part according to any of the first to the sixth aspects, further comprising, on the insulating substrate, a resistance film of an arcuate shape concentric with the through hole, and an external terminal electrode corresponding to the respective end portions of the resistance film, wherein the adjustment rotor includes a sliding piece disposed in sliding contact with the resistance film.

Advantages of the Invention

Locating the portion of the bottom plate of the adjustment rotor that is fitted over the shaft portion at a lower level than the uppermost edge of the inner portion of the through hole on the upper surface of the insulating substrate according to the first aspect brings the upper end portion of the shaft portion crimped to extend outward to a lower level in height, than in the conventional case where the portion of the bottom plate of the adjustment rotor that is fitted over the shaft portion is disposed in contact with the upper surface of the insulating substrate.

Such configuration permits increasing the insertion depth of the screwdriver into the rotor when inserting it for rotating the rotor, by the same amount as the downward shift of the upper end portion of the shaft portion crimped to extend outward, without increasing the height of the rotor from the upper surface of the insulating substrate, thereby effectively reducing the overall height of the chip type variable electronic part, while achieving the increase in insertion depth of the screwdriver into the rotor, and without reducing the thickness of the insulating substrate thus reducing the strength thereof.

Further, locating both of the portion of the bottom plate of the adjustment rotor that is fitted over the shaft portion and the upper end portion of the shaft portion crimped to extend outward at a lower level than the uppermost edge of the inner portion of the through hole on the upper surface of the insulating substrate, according to the second aspect, enables further increasing the insertion depth of the screwdriver when inserting it into the rotor, than in the case of the second aspect, thereby enhancing the foregoing effect.

Disposing the portion of the bottom plate of the adjustment rotor that is fitted over the shaft portion in contact with the internal terminal electrode plate according to the third aspect allows alleviating an impact applied to the insulating substrate originating from the crimping work, when crimping the upper end portion of the shaft portion to extend outward, thereby reliably preventing the insulating substrate from cracking because of the crimping work, thus improving the yield.

In the third aspect, interposing a friction plate between the bottom plate of the rotor and the internal terminal electrode plate according to the sixth aspect allows stably creating a predetermined rotational resistance against the rotation of the rotor, thereby facilitating stably performing the adjustment and preventing undue displacement of the adjustment position.

Further, the configuration according to the fourth or the fifth aspect reliably prevents intrusion of flux or the like into an inner portion of the rotor through the hollow shaft portion during a soldering implementation on a PCB and so on, without providing anything that may protrude from the lower surface of the insulating substrate, and hence without increasing the overall height of the chip type variable electronic part.

Especially, the configuration according to the seventh aspect is advantageous in effectively achieving the foregoing effects in the chip type variable resistor.

REFERENCE NUMERALS

Figure 1:
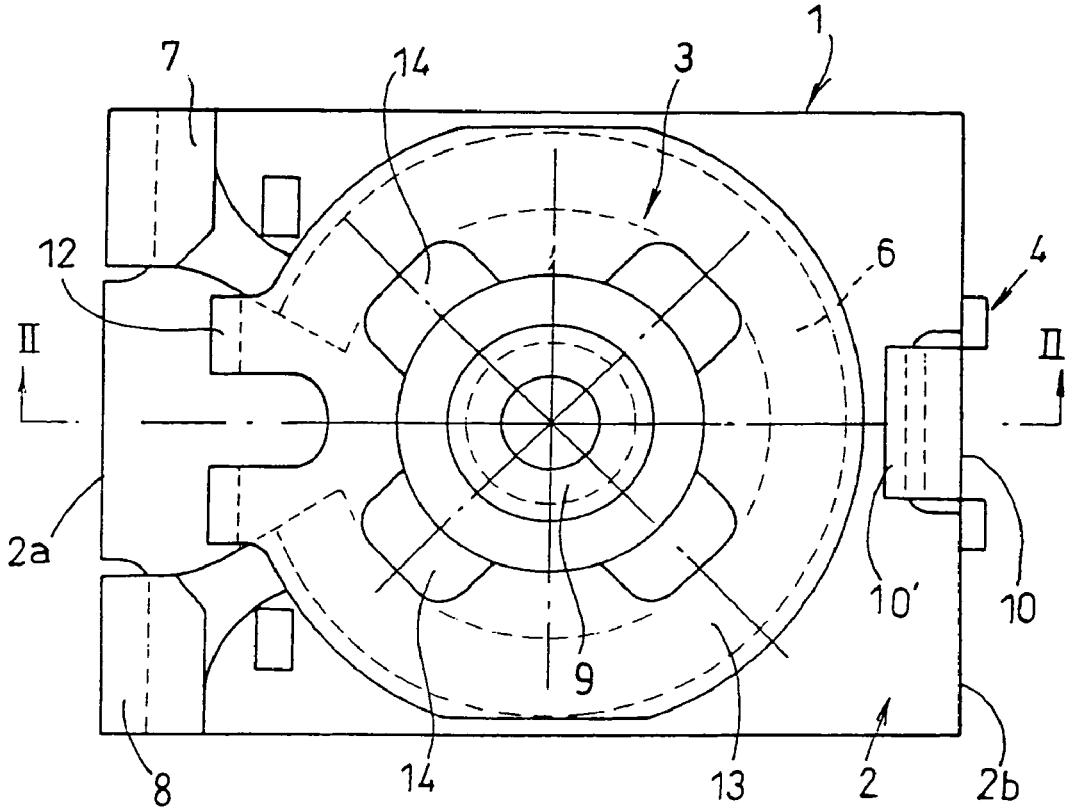
FIG. 1 is a plan view showing a chip type variable resistor according to a first embodiment of the present invention.
Figure 2:
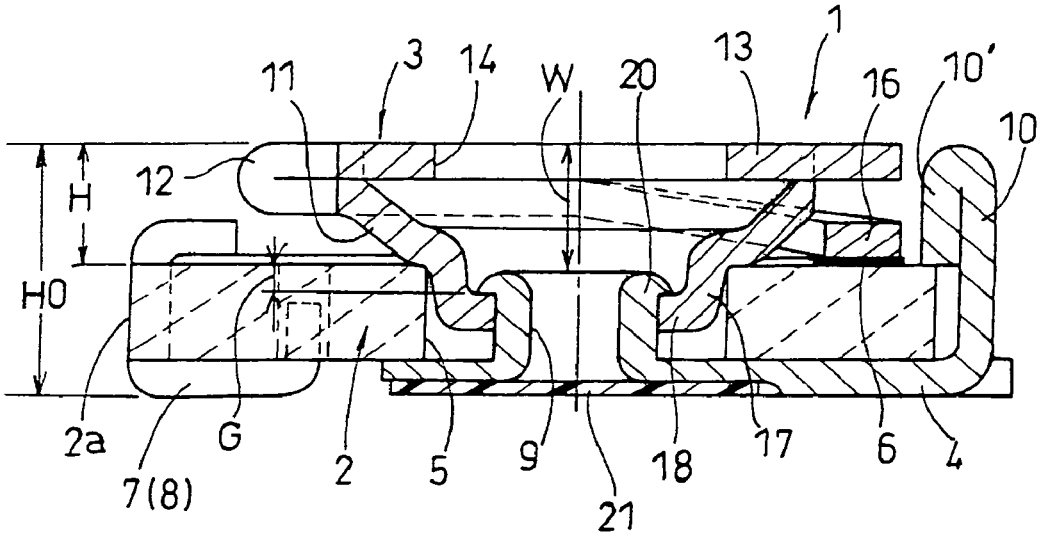
FIG. 2 is a cross-sectional view taken along the line II-II in FIG. 1.
Figure 3:
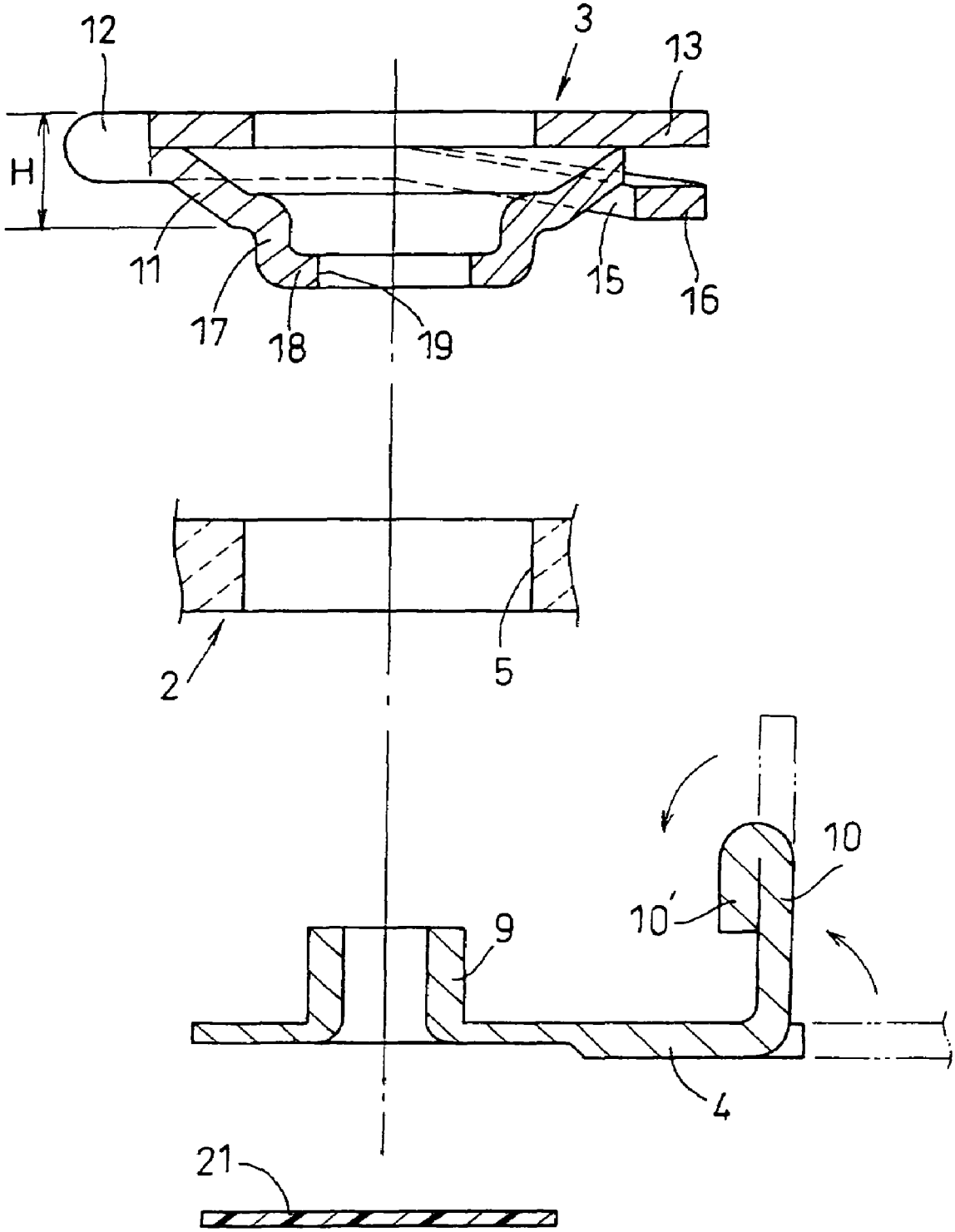
FIG. 3 is an exploded cross-sectional view based on FIG. 2.

1 chip type variable resistor
2 insulating substrate
3 adjustment rotor
4 internal terminal electrode plate
5 through hole
6 resistance film
7, 8 external terminal electrode
9 hollow shaft portion
10 stopper piece
11 the first plate
12 fold-back joint
13 the second plate
14 screwdriver engagement hole
16 sliding piece
17 bottom portion
18 bottom plate
20 portion crimped to extend outward
21 film
22 fold-back piece
24 friction plate

BEST MODE FOR CARRYING OUT THE INVENTION

An embodiment of the present invention will be described below referring to the drawings, in which the present invention is applied to a chip type variable resistor.

Among the drawings, FIGS. 1 to 4 depict a chip type variable resistor 1 according to a first embodiment.

The chip type variable resistor 1 includes an insulating substrate 2 in the form of a chip made of a heat-resistant insulating material such as a ceramic, an adjustment rotor 3 disposed on the insulating substrate 2, and an internal terminal electrode plate 4 disposed on the lower surface of the insulating substrate 2.

The insulating substrate 2 is formed with a through hole 5 extending from the upper surface to the lower surface of-the substrate at a generally central position, and a resistance film 6 disposed to extend thereon in an arcuate shape concentric with the through hole 5, and the insulating substrate 2 is provided, on a lateral face 2*a* thereof, with external terminal electrodes 7, 8 corresponding to the respective end portions of the resistance film 6.

The internal terminal electrode plate 4 is made of a metal plate and disposed in close contact with the lower surface of the insulating substrate 2, and includes a shaft portion 9 of a relatively small diameter integrally formed therewith to be inserted into the through hole 5, and a stopper piece 10 integrally formed therewith to be bent upward along another lateral portion 2*b* of the insulating substrate 2.

The rotor 3 includes a first plate 11 made of a metal plate and formed in a bowl shape with a flange around an outer periphery thereof, and a plate-shaped second plate 13 integrally connected to the first plate 11 via a fold-back joint 12, and the second plate 13 includes a cross-shaped screwdriver engagement hole 14 perforated therethrough, and is bent to be folded back at the fold-back joint 12 thus to be superposed on the upper surface of the first plate 11, while the flange on the outer periphery of the first plate 11 includes a slit hole 15 perforated in a generally semicircular arc in a region opposite to the fold-back joint 12, and a portion of the flange radially outer from the slit hole 15 constitutes a sliding piece 16 to be brought into elastic contact with the resistance film 6.

The bowl shaped first plate 11 of the rotor 3 includes a bottom portion 17 that fits in the through hole 5, and a bottom plate 18 of the bottom portion 17 is placed at a level lower by an appropriate distance G than an uppermost edge of an inner portion of the through hole 5 on the upper surface of the insulating substrate 2.

The upper end portion of the shaft portion 9 is inserted into the mounting hole 19 perforated through the bottom plate 18, such that a peripheral portion of the rotor 3 radially outer than the bottom portion 17 is brought into close contact with the upper surface of the insulating substrate 2 and the sliding piece 16 makes elastic contact with the resistance film 6, and under such state the upper end portion of the shaft portion 9 is crimped to extend outward over the upper surface of the bottom plate 18 (such crimped portion is designated by the reference numeral 20), so that the rotor 3 is mounted on the insulating substrate 2 to rotate about the shaft portion 9.

Figure 4:
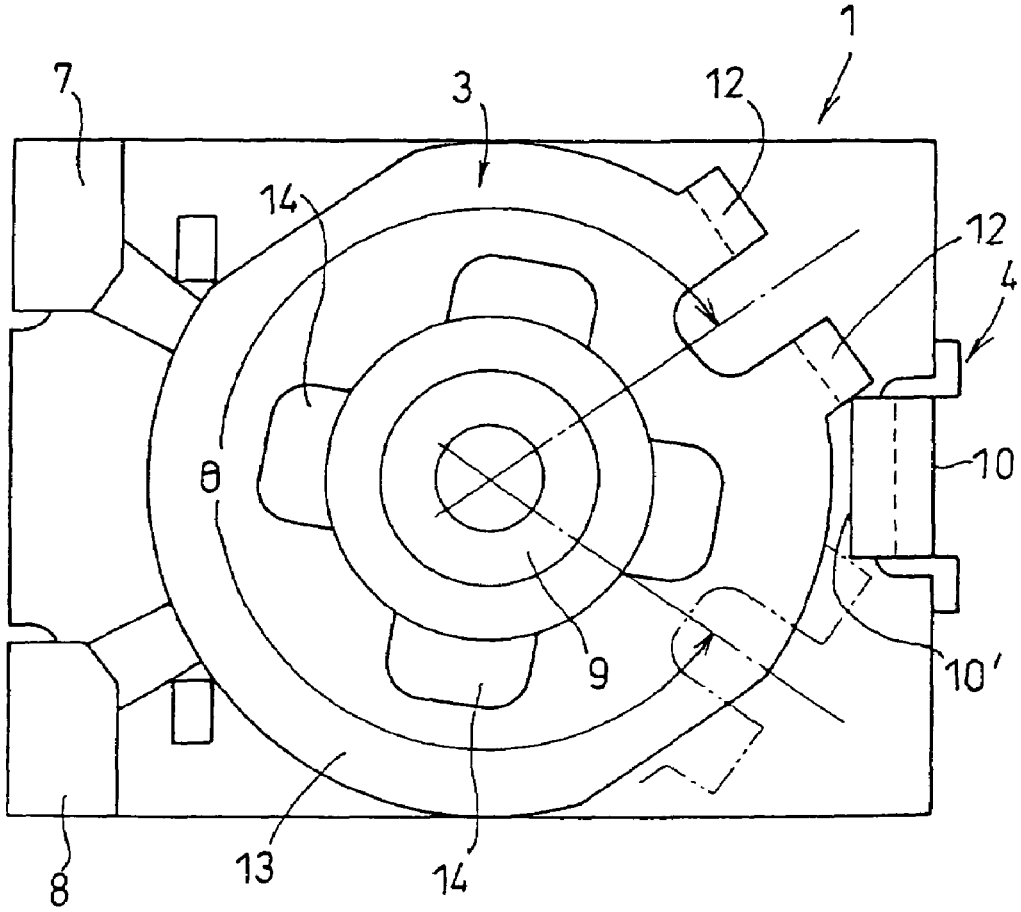
FIG. 4 is a plan view showing a state where the rotor is rotated.

Also, when the rotor 3 is rotated to left and right with the screwdriver inserted therein to get engaged with the screwdriver engagement hole 14, the fold-back joint 12 of the rotor 3 is butted to the stopper piece 10 as shown in FIG. 4, so that the rotation range of the rotor 3 is thereby delimited within an angle of θ.

Also, the peripheral portion of the rotor 3 radially outer than the bottom portion 17 is disposed in contact with the upper surface of the insulating substrate 2, either directly or via the friction plate interposed therebetween, thereby granting a predetermined rotational resistance against the rotation of the rotor 3.

Further, the plate thickness of the shaft portion 9 of the internal terminal electrode plate 4 is partially reduced, and a film 21 that covers the inner portion of the hollow shaft portion is adhered to the lower surface of the portion with the reduced thickness, to prevent intrusion of flux or the like into the inner portion of the rotor 3 through the hollow shaft portion 9 during a soldering implementation of the chip type variable resistor 1 on a PCB and so on.

In the chip type variable resistor 1 thus configured, as already stated, the bowl shaped first plate 11 of the rotor 3 includes a bottom portion 17 that fits in the through hole 5, and a bottom plate 18 of the bottom portion 17 is placed at a level lower by an appropriate distance G than an uppermost edge of an inner portion of the through hole 5 on the upper surface of the insulating substrate 2, and the upper end portion of the shaft portion 9 fitted in the through hole 5 is crimped to extend outward over the upper surface of the bottom plate 18. Therefore, the upper end portion 20 of the shaft portion 9 crimped to extend outward is brought to a lower level in height, than in the conventional case where the portion of the bottom plate 18 that is fitted over the shaft portion 9 is disposed in contact with the upper surface of the insulating substrate 2.

Such configuration permits increasing the insertion depth W of the screwdriver into the rotor 3 when inserting it for rotating the rotor 3, by the same amount as the downward shift of the upper end portion 20 of the shaft portion 9 crimped to extend outward, without increasing the height H of the rotor 3 from the upper surface of the insulating substrate 2, thereby effectively reducing the overall height H0 of the chip type variable resistor 1, while achieving the increase in insertion depth of the screwdriver into the rotor 3, and without reducing the thickness of the insulating substrate 2 thus reducing the strength thereof.

Also, as already stated, reducing the height H of the rotor 3 from the upper surface of the insulating substrate 2 allows reducing the projecting height of the stopper piece 10, to which the fold-back joint 12 of the rotor 3 is to be butted, from the upper surface of the insulating substrate 2, thereby increasing the strength of the stopper piece 10 against tilting because of the collision of the fold-back joint 12.

Figure 5:
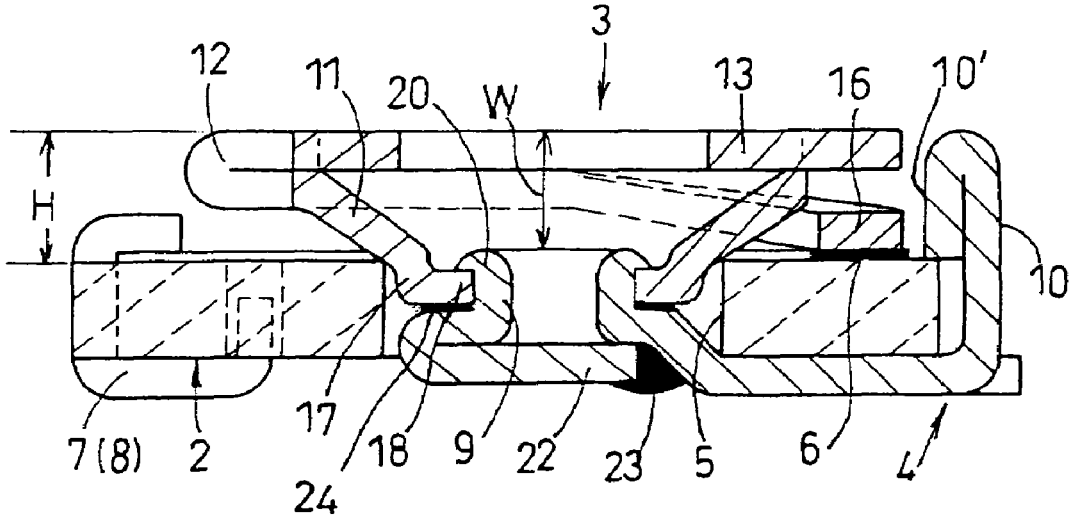
FIG. 5 is a vertical cross-sectional front view showing a chip type variable resistor according to a second embodiment.

Now, FIG. 5 depicts a chip type variable resistor according to a second embodiment.

The second embodiment is based on the configuration in which the bowl shaped first plate 11 of the rotor 3 includes a bottom portion 17 that fits in the through hole 5, and a bottom plate 18 of the bottom portion 17 is placed at a level lower by an appropriate distance G than an uppermost edge of an inner portion of the through hole 5 on the upper surface of the insulating substrate 2, but only the bottom plate 18 out of the bottom portion 17 is brought into contact with the upper surface of the internal terminal electrode plate 4 while the bottom portion 17 is kept from contacting the insulating substrate 2, and the upper end portion of the shaft portion 9 is crimped to extend outward, over the upper surface of the bottom plate 18 thus disposed.

In such configuration also, the upper end portion 20 of the shaft portion 9 crimped to extend outward is located at a lower level in height than the conventional case where the portion of the bottom plate 18 that is fitted over the shaft portion 9 is disposed in close contact with the upper surface of the insulating substrate 2, and therefore the insertion depth W of the screwdriver into the rotor 3 when inserting it for rotating the rotor 3 can be increased by the same amount as the downward shift of the upper end portion 20 of the shaft portion 9 crimped to extend outward, without increasing the height H of the rotor 3 from the upper surface of the insulating substrate 2.

In the second embodiment, since the rotor 3 is not in contact with the insulating substrate 2 but only the bottom plate 18 of the rotor 3 is engaged with the internal terminal electrode plate 4, an impact applied to the insulating substrate originating from the crimping work can be alleviated, when crimping the upper end portion of the shaft portion 9 to extend outward.

To the rotation of the rotor 3, a predetermined rotational resistance is applied because of the engagement of the bottom plate 18 of the rotor 3 with the internal terminal electrode plate 4. Here, for stabilizing the rotational resistance against the rotor 3, the friction plate may be interposed between the bottom plate 18 and the internal terminal electrode plate 4.

Further, in the second embodiment, since the portion of the internal terminal electrode plate 4 around the hollow shaft portion 9 is located in the through hole 5, and a fold-back piece 22 is integrally formed with the portion of the internal terminal electrode plate 4 around the hollow shaft portion 9 to cover the inner portion thereof, the intrusion of flux or the like into an inner portion of the rotor 3 through the hollow shaft portion 9 can be prevented during a soldering implementation of the chip type variable resistor on a PCB and so on, without providing anything that may protrude from the lower surface of the insulating substrate 2.

Here, the reference numeral 23 in FIG. 5 showing the second embodiment designates a synthetic resin material applied to the periphery of the fold-back piece 22 for further assuring the prevention of the intrusion of the flux or the like.

Figure 6:
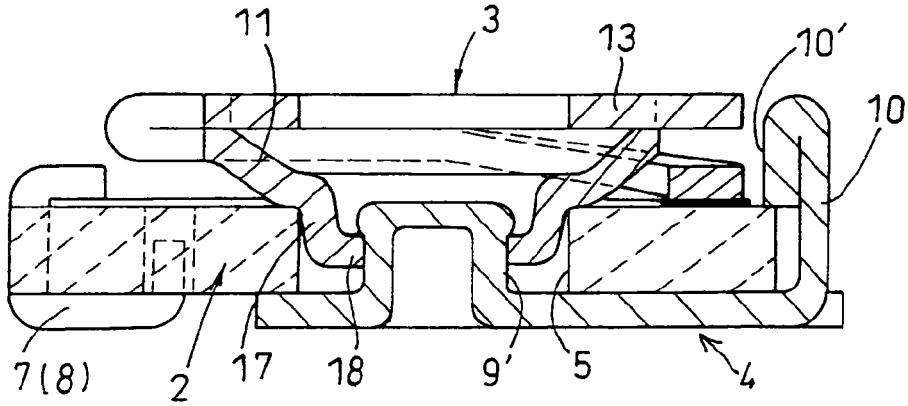
FIG. 6 is a vertical cross-sectional front view showing a chip type variable resistor according to a third embodiment.

FIG. 6 depicts a chip type variable resistor according to a third embodiment.

The third embodiment represents a configuration in which a hollow the shaft portion 9' integrally formed with the internal terminal electrode plate 4 is formed to close the upper end to prevent the intrusion of the flux or the like through the hollow shaft portion 9, instead of adhering the film 21 and forming the fold-back piece 22. Such configuration further ensures prevention of the intrusion of the flux or the like.

Figure 7:
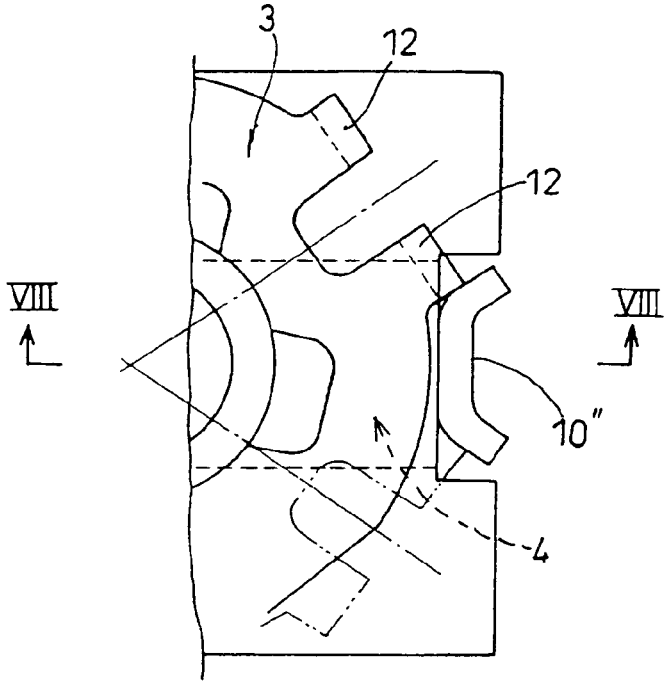
FIG. 7 is a plan view showing a chip type variable resistor according to a fourth embodiment.
Figure 8:
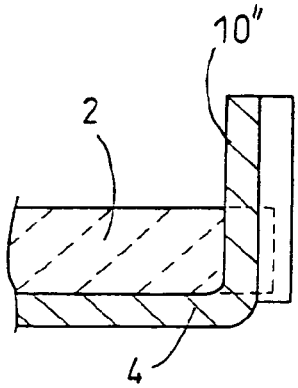
FIG. 8 is a cross-sectional view taken along the line VIII-VIII in FIG. 7.

Further, according to the foregoing embodiments, the stopper piece 10 integrally formed with the internal terminal electrode plate 4 for delimiting the rotation of the rotor 3 within a predetermined rotation angle θ includes a folded portion 10' disposed to be butted to the upper surface of the insulating substrate 2, and the folded portion 10' and the internal terminal electrode plate 4 hold the insulating substrate 2 therebetween, thereby increasing the strength of the stopper piece 10 against tilting and the attaching strength of the internal terminal electrode plate 4 to the insulating substrate 2, however, without limitation to such configuration, the stopper piece integrally formed with the internal terminal electrode plate 4 for delimiting the rotation of the rotor 3 within a predetermined rotation angle o may be constituted as a stopper piece 10" according to a fourth embodiment shown in FIGS. 7 and 8, in a shape having an outwardly open C-shaped cross-section.

The invention claimed is:

1. A chip type variable electronic part comprising: an insulating substrate with a through hole; an adjustment rotor formed of a metal plate in a bowl shape to receive a screwdriver and disposed on an upper surface of the insulating substrate; an internal terminal electrode plate made of a metal plate disposed in close contact with a lower surface of the insulating substrate; and a shaft portion integrally formed with the internal terminal electrode plate to be fitted in the through hole; the adjustment rotor including a bottom plate rotatably fitted to an upper end portion of the shaft portion, the upper end portion of the shaft portion being crimped to outwardly extend over an upper surface of the bottom plate, wherein the bottom plate of the adjustment rotor includes a portion that is fitted to the shaft portion, this portion being located at a lower level than an uppermost edge of an inner portion of the through hole on the upper surface of the insulating substrate, wherein the adjustment rotor is supported, at a bowl-shaped portion radially outward relative to the bottom plate, by the upper surface of the insulating substrate, and wherein a plate thickness of a portion of the internal terminal electrode plate around the shaft portion is partially reduced, and a film that covers an inner portion of the hollow shaft portion is adhered to a lower surface of the portion with the reduced thickness.

2. The chip type variable electronic part according to claim 1, wherein the portion of the bottom plate of the adjustment rotor that is fitted to the shaft portion and the upper end portion of the shaft portion crimped to extend outward are both located at a lower level than the uppermost edge of the inner portion of the through hole on the upper surface of the insulating substrate.

3. The chip type variable electronic part according to claim 2, further comprising a stopper folded toward the through hole.

4. The chip type variable electronic part according to claim 1, further comprising a resistance film of an arcuate shape concentric with the through hole on the substrate, external terminal electrodes corresponding to end portions of the resistance film, and a sliding piece provided on the rotor and held in sliding contact with the resistance film.

5. The chip type variable electronic part according to claim 4, further comprising a stopper folded toward the through hole.

6. The chip type variable electronic part according to claim 1, further comprising a stopper folded toward the through hole.

7. A chip type variable electronic part comprising: an insulating substrate with a through hole; an adjustment rotor formed of a metal plate in a bowl shape to receive a screwdriver and disposed on an upper surface of the insulating substrate; an internal terminal electrode plate made of a metal plate disposed in close contact with a lower surface of the insulating substrate; and a shaft portion integrally formed with the internal terminal electrode plate to be fitted in the through hole; the adjustment rotor including a bottom plate rotatably fitted to an upper end portion of the shaft portion, the upper end portion of the shaft portion being crimped to outwardly extend over an upper surface of the bottom plate, wherein the bottom plate of the adjustment rotor includes a portion that is fitted to the shaft portion, this portion being located at a lower level than an uppermost edge of an inner portion of the through hole on the upper surface of the insulating substrate, wherein the adjustment rotor is supported, at a bowl-shaped portion radially outward relative to the bottom plate, by the upper surface of the insulating substrate, and wherein the portion of the internal terminal electrode plate around the shaft portion is located in the through hole, and includes a fold-back piece integrally formed in the portion around the shaft portion to cover an inner portion thereof.

8. The chip type variable electronic part according to claim 7, wherein the portion of the bottom plate of the adjustment rotor that is fitted to the shaft portion and the upper end portion of the shaft portion crimped to extend outward are both located at a lower level than the uppermost edge of the inner portion of the through hole on the upper surface of the insulating substrate.

9. The chip type variable electronic part according to claim 8, further comprising a stopper folded toward the through hole.

10. The chip type variable electronic part according to claim 7, further comprising a resistance film of an arcuate shape concentric with the through hole on the substrate, external terminal electrodes corresponding to end portions of the resistance film, and a sliding piece provided on the rotor and held in sliding contact with the resistance film.

11. The chip type variable electronic part according to claim 10, further comprising a stopper folded toward the through hole.

12. The chip type variable electronic part according to claim 7, further comprising a stopper folded toward the through hole.

* * * * *